US010932597B1

(12) United States Patent
Lingel

(10) Patent No.: US 10,932,597 B1
(45) Date of Patent: Mar. 2, 2021

(54) FLUID CONTAINER FOR FACILITATING ACTIVITY PLANNING

(71) Applicant: Thomas Lingel, Cazenovia, NY (US)

(72) Inventor: Thomas Lingel, Cazenovia, NY (US)

( * ) Notice: Subject to any disclaimer, the term of this patent is extended or adjusted under 35 U.S.C. 154(b) by 0 days.

(21) Appl. No.: 16/702,413

(22) Filed: Dec. 3, 2019

Related U.S. Application Data

(63) Continuation-in-part of application No. 15/349,292, filed on Nov. 11, 2016, now abandoned.

(60) Provisional application No. 62/255,483, filed on Nov. 15, 2015.

(51) Int. Cl.
*B65D 23/14* (2006.01)
*A47G 19/22* (2006.01)
*A45F 3/18* (2006.01)

(52) U.S. Cl.
CPC ..... *A47G 19/2227* (2013.01); *A45F 3/18* (2013.01); *B65D 23/14* (2013.01)

(58) Field of Classification Search
CPC ..... A47G 19/2227; A45F 3/18; B65D 23/14
USPC ..... 206/457; 215/365
See application file for complete search history.

(56) References Cited

U.S. PATENT DOCUMENTS 3,386,200 A * 6/1968 Beretta ..... G09F 3/02 40/310
7,673,764 B2 * 3/2010 Sabold ..... B65D 1/44 215/381
2014/0291279 A1 * 10/2014 Robertos ..... A61J 7/0409 215/365

* cited by examiner

*Primary Examiner* — Jacob K Ackun
(74) *Attorney, Agent, or Firm* — Kenneth J. Lukacher Law Group; R. S. Rosenholm

(57) ABSTRACT

The invention provides an apparatus and method for storing and modifying information that is disposed along an outside surface of a container. Optionally, the information is stored onto one or more strips that are each marked with information that facilitates exercise and other types of activity planning.

9 Claims, 6 Drawing Sheets

FLUID CONTAINER FOR FACILITATING ACTIVITY PLANNING

CROSS REFERENCE TO RELATED PATENT APPLICATION(S)

This document is a continuation-in-part of, and claims priority and benefit to, United States (U.S.) non-provisional utility patent application having Ser. No. 15/349,292, that was filed on Nov. 11, 2016, and that is entitled "FLUID CONTAINER FOR FACILITATING ACTIVITY PLANNING", and which is incorporated herein by reference in its entirety. The non-provisional utility patent application having Ser. No. 15/349,292 claims priority and benefit under 35 U.S.C. 119 (e) to U.S. (utility) provisional patent application having Ser. No. 62/255,483, that was filed on Nov. 15, 2015 and that is entitled "BOTTLE PLANNER", and which is incorporated herein by reference in it's entirely.

BACKGROUND OF THE INVENTION

People perform exercises to promote better health. Some types of exercises, such as swimming, require people to immerse themselves in water and/or to perform such exercises in or at a facility that is typically located away from home. Water and other fluids are often consumed when exercising. Such fluids can be stored into portable containers and carried to a place of exercise, such as a pool, athletic field or gymnasium, for example.

The discussion above is merely provided for general background information and is not intended to be used as an aid in determining the scope of the claimed subject matter.

BRIEF DESCRIPTION OF THE INVENTION

The invention provides an apparatus (mechanism) and method for storing (encoding) and modifying information that is disposed (marked) along an outside surface of a container. In some embodiments, the information is stored onto one or more strips that are each marked with information that facilitates exercise and other types of activity planning.

This brief description of the invention is intended only to provide an overview of subject matter disclosed herein according to one or more illustrative embodiments, and does not serve as a guide to interpreting the claims or to define or limit the scope of the invention, which is defined only by the appended claims.

BRIEF DESCRIPTION OF THE DRAWINGS

So that the manner in which the features of the invention can be understood, a detailed description of the invention to certain embodiments of the invention is provided herein, some of which are illustrated in the accompanying drawings. It is to be noted, however, that the drawings illustrate only certain embodiments of this invention and are therefore not to be considered limiting of its scope, for the scope of the invention can encompass other equally effective embodiments.

The drawings are not necessarily to scale. The emphasis of the drawings is generally being placed upon illustrating the features of certain embodiments of the invention. In the drawings, like numerals are used to indicate like parts throughout the various views. Differences between like parts may cause those parts to be indicated with different numerals. Thus, for further understanding of the invention, reference can be made to the following detailed description, read in connection with the drawings in which.

DETAILED DESCRIPTION OF THE INVENTION

Figure 1B:
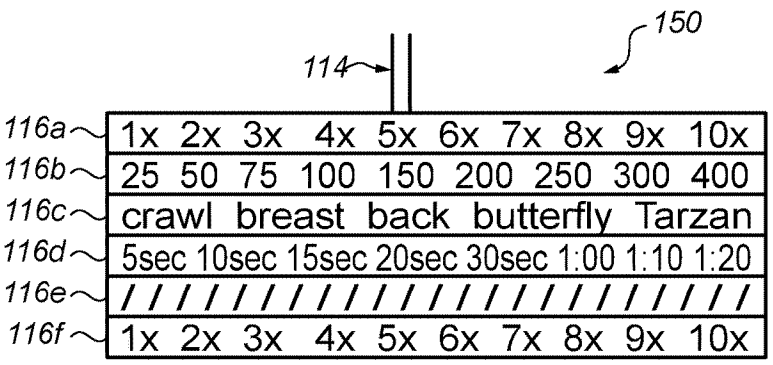
FIGS. 1A-1C each illustrate a first embodiment of a fluid container in accordance with the invention.
Figure 1C:
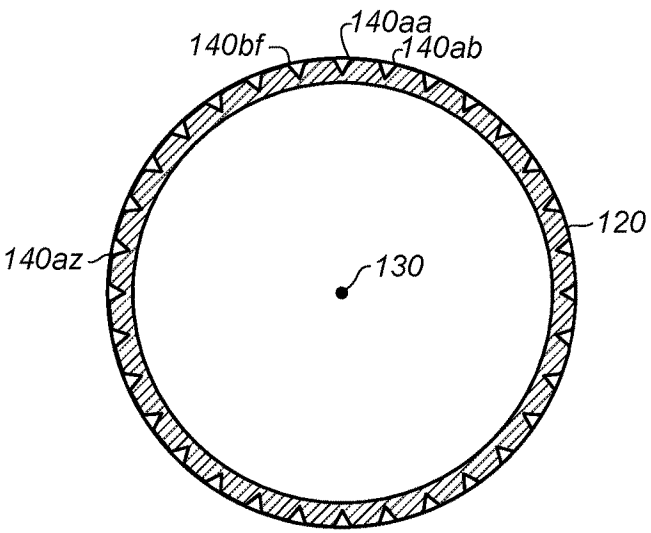
Figure 1A:
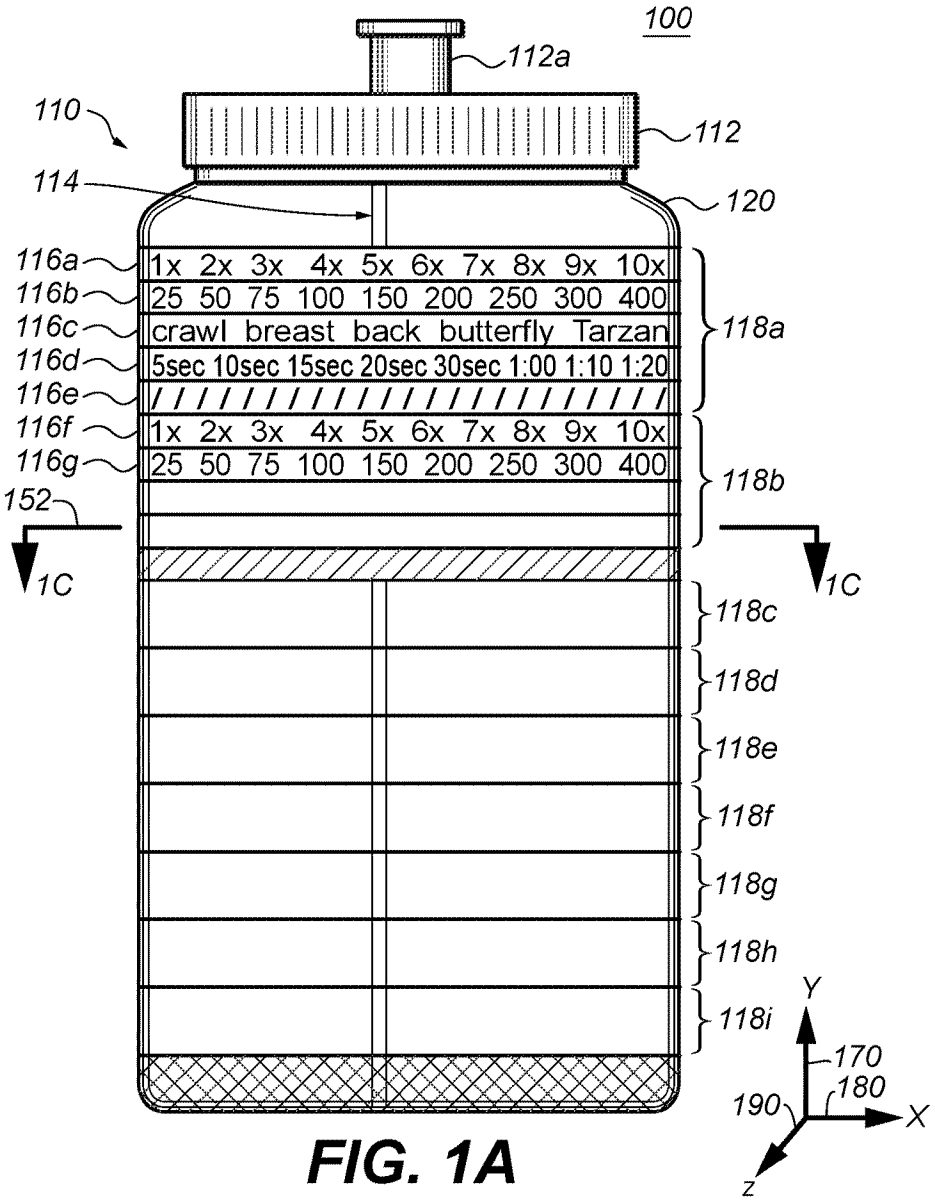

FIGS. 1A-1B each illustrate a side perspective view 100 of a container 110 in accordance with the invention. Referring to FIG. 1A, the container 110, also referred to herein as a bottle 110 or water bottle 110, includes a body 120, a removable and re-attachable cap 112 and an outlet (opening) 112*a*. The outlet 112*a* can be sealed via a cap 112. The cap 112 is designed to attach to the body 120. In the embodiment shown, the cap 112 is designed to include an internal set of circular threads (not shown) which are designed to engage circular threads that are disposed along an upper portion of the body 120 and along an edge of the opening 112*a* (not shown here). The body 120 functions as a container to store a material, perhaps a fluid, such as water, for example. In some embodiments, the container 110 may include other openings to serve other functions, such as for cleaning etc.

In some embodiments, the outer surface of the body 120 is further designed to preferably include a marking, being a visible marking line 114, and a set of one or more information strips 116*a*-116*e*, also referred to herein as strips 116, rings 116 or sleeves 116, that form one grouping (set) of information 118*a* and that are configured to be visible from a viewing perspective outside of the container 110. Preferably, the body 120 of the container has a horizontal cross-section, being a cross-section that is oriented parallel to a two dimensional plane defined by the X 180 and Z 190 axes, and that horizontal cross-section has a shape that is circular. In some embodiments, a marking line 114 is stored onto an information strip 116, supplementing, or alternatively in place of (substituting for), a marking line 114 being located (marked) onto the body 120.

The marking line 114 is employed to facilitate interpretation of information that is stored (marked) onto the set of one or more information strips 116*a*-116*g*. Each information strip 116 is designed to be marked with information that is viewable from outside of the fluid container 110. Such information is marked onto each information strip 116 via etching and/or printing of a plurality of one or more and various types of symbols onto each strip 116. These symbols include alphanumeric characters, including such as alphabetic text and numeric digits, and/or other graphic symbols that are intended to represent information that has meaning in the context of a particular circumstance or activity.

Such information encoded into a grouping of information strips can represent one or more attributes of a circumstance or activity. Information from one information strip can represent (encode) one attribute. Optionally, such an attribute can be represented by a numeric value.

As shown in FIG. 1A, this embodiment of the container 110 has a long dimension that is shown as being parallel to a Y axis 170. The container 110 has a shape that includes a circular cross-section (not shown here) that is parallel to a two dimensional plane that is defined by a combination of the X 180 and the Z 190 axes. The body 120 also has an associated center axis 130 that is located at a geometric center of a horizontal cross-section of the body 120, as shown in FIGS. 1C and 2B. The outer surface of the body 120, as shown in FIG. 1C, curves around and surrounds the center axis 130. As shown in FIG. 1A, the long dimension of the container 110 is parallel to the center axis 130. While attached to a curved outer (side) surface of the container 110, each of the information strips 116 are shown as being bent along and disposed along the curved outer surface and along an outer perimeter of the above referred to circular cross-section of the container 110.

Figure 2A:
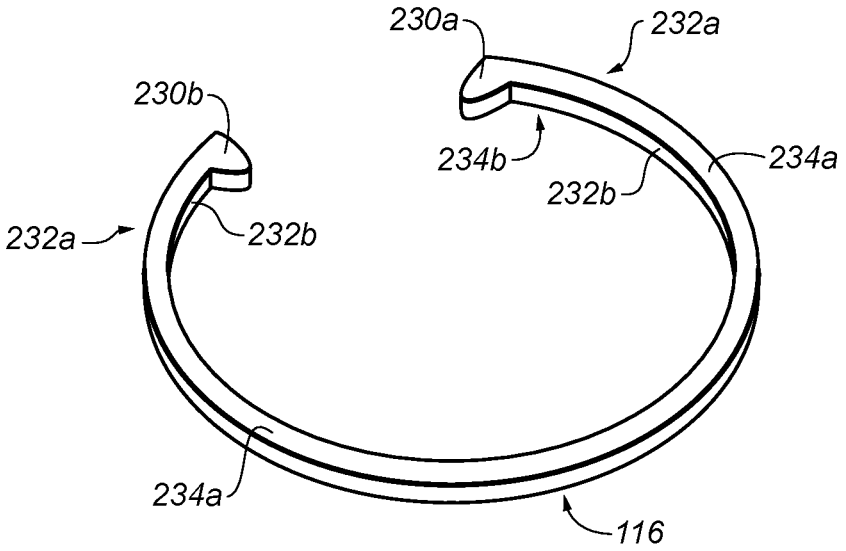
FIGS. 2A-2C illustrate a first embodiment of an information strip that is designed to attach to an outer surface of the fluid container of FIGS. 1A-1C.
Figure 2B:
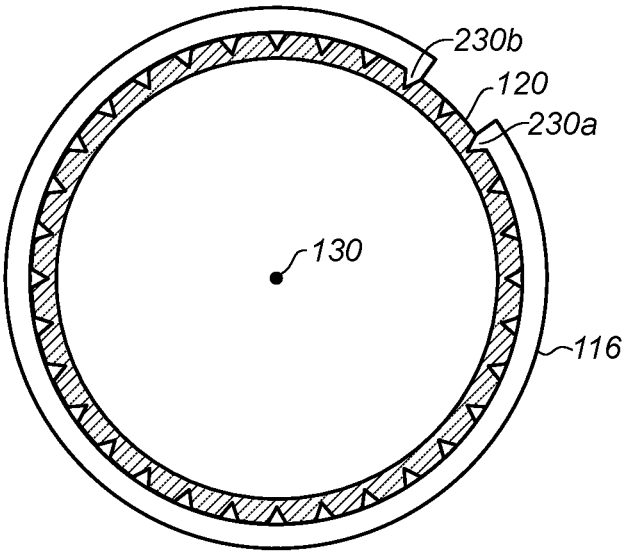

Referring to FIG. 1B, this figure (drawing) provides an enlarged perspective view of the set (group) of (6) adjacent information strips 116*a*-116*e* of FIG. 1A while attached to the container 110 of FIG. 1A In this embodiment, each information strip 116, which is also referred to herein as a strip 116, ring 116 or sleeve 116, is an object having a long dimension that is terminated by two ends, as shown in FIG. 2A. Each end has a protrusion that is shaped like a hook and that protrudes in a perpendicular manner away from the long dimension of the strip 116 and towards an outer surface of the body 120 of the fluid container 110. (See FIG. 2A).

The body 120 of the fluid container includes a plurality of (cavities) indentations that are each configured to receive the protrusion at an end of each strip 116. When both ends of each strip 116 are pushed into and received into a separate indentation along the outer surface of the body 120 of the container 110, the strip 116 becomes attached to the body 120 of the container 110 via a friction fit between each protrusion and each cavity (indentation).

As shown in FIG. 1B, an information strip 116*a* is marked with information that is expressed as "1X 2X 3X 4X 5X 6X 7X 8X 9X 10X". Each of these markings represents (encodes) a count value. For example, "7X" represents a count value equal to seven (7). The information strip 116*b* is disposed just below and adjacent to information strip 116*a*.

The information strip 116*b* is marked with information that is expressed as "25 50 75 100 150 200 250 300 400". Each of these values represents a distance. For example, the marking "75" can represent (encode) (75) yards, or (75 meters) or (75) feet, in accordance with a particular planned activity that is associated with a user (holder) of the container 110. The information strip 116*c* is disposed just below and adjacent to information strip 116*b*.

The information strip 116*c* is marked with information that is expressed as "crawl breast back butterfly Tarzan". Each of the words represent a type of swimming exercise. For example, "breast" represents a breast stroke type of swimming exercise, "back" represents a back stroke type of swimming exercise, etc. The information strip 116*d* is disposed just below and adjacent to information strip 116*c*.

In other embodiments of the invention, the backstroke swim exercise could be represented by the words "back stroke" or "Back Stroke", instead of being represented by the word "back" or "Back", which is an abbreviation of the word "back stroke", as shown as being marked onto the strip 116*c*. (See FIGS. 1A-1B).

However, such a marking as "back stroke", although within the scope of this invention, is a lengthened marking that would consume additional marking space on the strip 116*c*, and in combination with other lengthened markings, such as "breast stroke" instead of "breast", for example, would limit one strip 116*c* to indicate a lesser selection (number) of types of swim exercises. Hence, there is a motivation to abbreviate the words representing a particular swim exercise, or other type of exercise or activity.

The information strip 116*d*, is marked with information that is expressed as "5 sec 10 sec 15 sec 20 sec 30 sec 1:00 1:10 1:20". Each of these values represents a period of time. For example, "5 sec" represents five (5) seconds, "30 sec" represents thirty (30) seconds, and "1:00" represents one (1) minute plus "00" seconds, and "1:20" represents (1) one minute plus "20" seconds. The information strip 116*e* is disposed just below and adjacent to information strip 116*d*.

In accordance with the invention, a user (holder) of the container 110 arranges the above described strips to be disposed within a group of strips, where each strip within the group of strips is aligned with a marking line that is located on the outside surface of the body of the fluid container and/or located on a particular information strip 116 within the group of strips. In other words, the markings of each strip within a group of strips are each designed to be interpreted in the context of the markings of other strips within that group of strips.

Typically, the person arranging a group of strips, is the user (holder) of the container 110 and is the same person who will be interpreting the arrangement of that same group of strips at some time in the future. The strip 116*e* is referred to herein as a spacer strip, which is employed to separate groups of adjacent strips. The spacer strip 116*e* functions as a delimiter between a group of strips 116*a*-116*d* above, and a group of strips, that includes the strip 116*f*, shown below the spacer strip 116*e*. The entire group of strips including strip 116*f* and 116*g*, is not shown here.

However, many groups of information strips 118*a*-118*h* can be attached to the container 110. Each group of strips 118*a*-118*h* can represent parameters describing a separate exercise. Use of the spacer strip 116 is not necessary, but optional. Also, each group of strips 118*a*-118*h* can be represented by a separate (distinct) color to easily and visually distinguish one group 118 of strips 116 from another group 118 of strips 116, without necessarily employing a spacer strip 116*e*. Each group of strips 118*a*-118*h* can be employed to represent a different activity or type of activity.

Referring again to FIG. 1B, the marking line 114 is employed to define a line in space which aligns with (points to) various markings within the information strips 116. As shown, the marking line 114 aligns with the "5x" marking of strip 116*a*, the "150" marking of strip 116*b*, the "back" marking of strip 116*c* and the "20 sec" marking of strip 116*d*.

Collectively, the group of information pointed to by the marking line 114, specifically "5x", "150", "back" and "20 sec", is employed to represent parameters for a swimming exercise, specifically performing the backstroke swim exercise, in (5) sets of exercise, where each set being a swimming exercise for a distance of "150" yards, and where each set is separated by a rest period of (20) seconds.

Should the exerciser, being a user (holder) of the fluid container 110, decide to swim 200 yards, instead of 150 yards, the strip 116*b* can be detached from the body 120 of the container 110, and then shifted (rotated) leftward around the body 120 of the container 110, so that the marking "200" of strip 116*b* is aligned with the marking line 114. Each and any strip 116 can be detached, shifted (rotated) and then re-attached to the body to align different units of information with the marking line 114. In other use scenarios, an time parameter can be employed to instead indicate a time, being a target time, within which the holder (user) of the container 110 will endeavor to complete each exercise set.

Note that the use scenarios for the embodiments described above, are generally classified as prospective, in that the above parameters are described with respect to an activity that is expected to take place sometime in the future. Alternatively, use scenarios of the invention can also be retrospective.

Optionally, in other use scenarios, an additional time parameter can be employed to indicate a time within which the exercise was actually completed. For example, a separate information strip 116 within an existing group of information strips, or a separate group of information strips 118 altogether, could retrospectively indicate an elapsed time that was measured for the user (holder) to complete performance of a particular exercise. For example, the user (holder) could employ one or more information strips to indicate the number of seconds that was measured and required for the holder (user) to complete a swim exercise having a length of 100 meters, for example.

Below the spacer strip 116*e*, other strips 116 can be arranged into groups 118*b*-118*h* to parameterize other exercises or activities, such as other swim exercises and/or other types of exercises, where other information strips 116 can be used to indicate other exercise parameters, such as weight training exercises, including weight, number of repetitions etc., with respect to weight training exercises, for example.

Note that parameters for some exercises can be voluminous and difficult to remember. For example, an exercise routine could require (4) different exercise stages with (3) different intermediate rest periods between exercise stages. Because a water bottle is typically essential to bring to an exercise activity, in accordance with the invention, a set of information describing a prospective exercise activity, is brought to the performance of that exercise activity, along with the water bottle. However, the information carried by the container 110 can be employed for a variety of types of activities, including exercise and other non-exercise related activities.

Figure 4B:
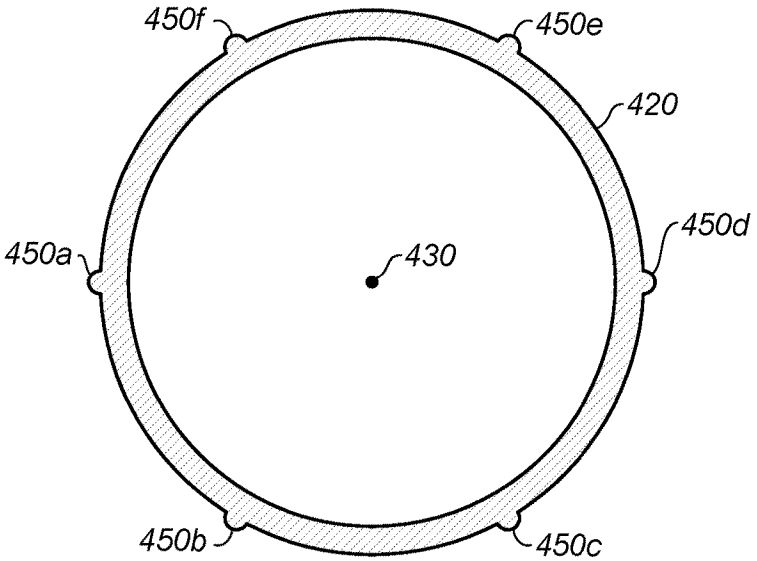
FIGS. 4A-4F illustrate a second embodiment of a fluid container and information strip combination.
Figure 4A:
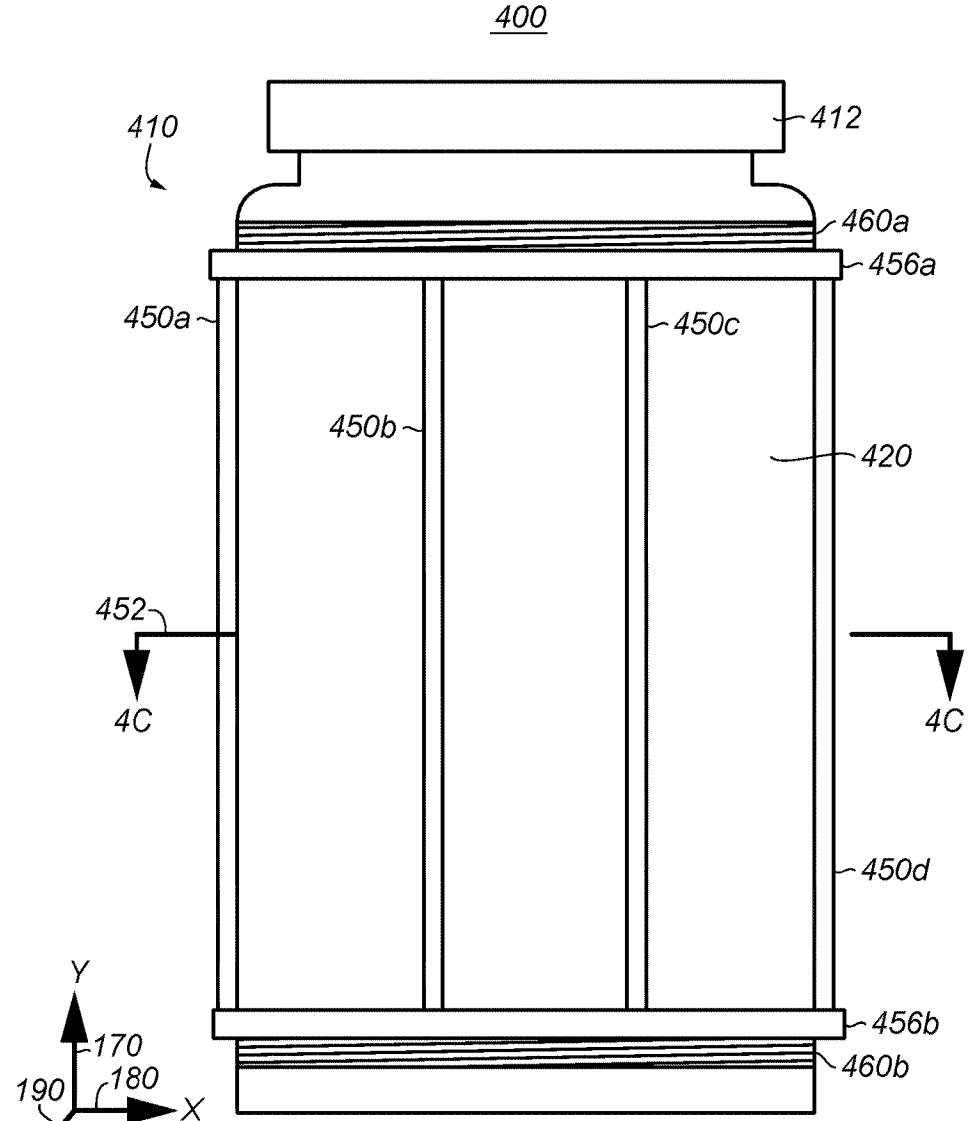

FIG. 1C illustrates a top-down cross-sectional view of the body 120 of the container 110 shown in FIG. 1A in accordance with the invention. The body 120 of FIG. 1A has a horizontal cross-section 152, that is oriented parallel to a two dimensional plane defined by a combination of the X 180 and Z 190 axes. Preferably, the horizontal cross-section of the body 420 has a shape that is curved and symmetrical in shape. As shown, the horizontal cross-section 452 of the body 420 of FIG. 4A is circular in shape. As shown, an outer curved surface includes (32) notches 140*aa*-140*bf* that are shaped and sized to receive protrusions 230*a*-230*b* of the information strip 116 shown in FIG. 2A. Preferably, these notches are located around the entire 360 degree perimeter of the outer surface of the body 120 and are each located at an equal distance from each other FIG. 2A illustrates a first embodiment of an information strip that is designed to attach to an outer surface of the container of FIGS. 1-2. The information strip 116, also referred to herein as a strip 116, is a long and slender shaped object having a long dimension and two separate ends. Each strip 116 is preferably made from a material that is flexible to an extent that it is suitable for bending into a curved shape, preferably via hand strength, while abutting along a curved surface, like that of a curved outer surface of a cylindrical shaped container or water bottle.

Each information strip 116 includes an outer curved side (surface) 232*a* and an inner curved side surface 232*b*, which are located on opposite sides of the information strip 116. Preferably, the information strip 116 is made from material that resists damage from physical contact with various materials that could be stored into the container 110, such as from physical contact with water and other fluids. Note that the information strips 116 are subject to becoming wet when in proximity to a swimming pool, and/or when exposed to a wet environment and/or wet weather.

In some embodiments, the strips 116 are preferably made from a plastic. As described above, each strip 116 has two separate ends and a protrusion 230*a*-230*b* at each respective and separate end. The portion of the strip 116 absent each protrusion is referred to herein as a central body portion of the strip 116. The central body portion is attached to a protrusion at each of its two ends. Each protrusion is designed to protrude in a perpendicular direction away from an outer curved side (surface) 232*a* of the strip 116. When attached to the outer curved side surface of the container 110, the protrusion of each strip 116 is directed towards and into a notch 140 (See FIG. 1C), being a cavity (hole/indentation) that is located along an outer curved surface of the body 120 of the fluid container 110.

Note that the outer curved surface 232*a*, is curved while the strip 116 is attached to the curved body 120 of the fluid container 110. Likewise, the inner curved surface 232*b*, is also curved while the strip 116 is attached to the curved body 120 of the fluid container 110. In some embodiments, a newly manufactured strip 116 may lie flat and straight, meaning that the outer surface 232*a* and the inner surface 232*b* may be un-curved and flat or nearly flat, as manufactured, prior to a bending of the strip 116 for attachment and abutting of the strip 116 around and to a curved body 120 of a fluid container 110.

The body 120 of the fluid container includes a plurality of cavities (holes/indentations) that are each configured to receive the protrusion 230*a*-230*b*. The protrusion 230*a*-230*b* is shaped and sized to friction fit into a same or similar shaped cavity (hole/indentation) that is disposed on the outside surface of the body 120 of the container 110. This friction fit being analogous to a tent stake being pushed into the earth and held by friction within the earth as would be required to secure the construction of a tent, for example. When both ends of each strip 116 are pushed into and received into separate cavities (holes. indentations) along the outer surface of the body 120 of the container 110, the strip 116 becomes attached to the body 120 of the container 110.

An outer surface 232*a* of the strip is where information is marked onto the strip 116. An inner surface 232*b* of the strip 116, as designed, makes physical contact with and abuts with an outer surface of the body 120 of the container 110, when the strip 116 is attached to the body 116 of the container 110. Preferably, an upper edge 234*a* of a first strip 116*b* makes physical contact with and abuts with a lower edge 234*b* of strip 116*a*, that is attached just above. Preferably, a lower edge 234*b* of the strip 116*b* makes physical contact with and abuts an upper edge 234*a* of strip 116*c* that is attached just below the strip 116*b*, when these strips 116 are attached to the body 120 of the container 110, as it is shown in FIGS. 1A-1B.

In the embodiment shown here, the upper 234*a* and lower 234*b* edges of the strip 116, which each abut with an edge of an adjacent strip 116, form a substantially straight line, and are referred to herein as straight edges. Having such straight edges, the strips 116 can be detached from the body 120 of the container 110 and horizontally rotated around while detached, and optionally slid along, the outer surface of the body 120 in order to differently align the markings of the strip 116 with the marking line 114, and/or to differently align the strip 116 with other information strips 116 that are attached to the body 120, prior to re-attachment of the strip 116 to the body 120.

In other embodiments, the information strip 116 is designed to ratchet and remain attached to the body 120 while rotating and sliding the information strip 116 to a different location around the circumference of the body 120 of the container 110. Such a ratcheting mechanism allows the strip 116 to be aligned differently in relation to the marking line 114, and in relation to other strips attached to the body 120 of the container 110, without necessarily detaching the strip 116 from the body 120 of the container 110.

FIG. 2B illustrates a top-down cross-sectional view of the information strip 116 of FIG. 2A as it is attached to the body 120 of the container 110 of FIG. 1A. As shown and designed, the information strip 116 can be rotated (positioned) around a perimeter of the curved outer surface of the body 120 of the container 110 and then attached to a particular location on the body 120, via hand manipulation. Each notch 140*aa*-140*bf* is designed to receive a protrusion 230*a*-230*b* from the information strip 116 in order to attach the information strip 116 to the body 120 of the container 110. Hand manipulation typically involves application of hand dexterity and hand strength while applying a force of ten pounds or less.

Figure 2C:
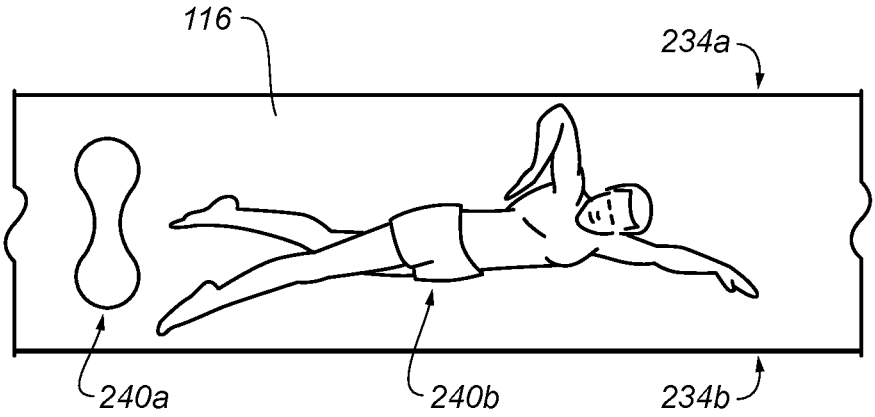

FIG. 2C illustrates a close perspective view of the first embodiment of an information strip of FIG. 2A, that is marked with graphic symbols. As shown, the information strip 116 includes markings 240*a*-240*b*.

The graphic symbol 240*a* is employed to represent a pull buoy. A pull buoy is a floating device that is designed to be placed in between the legs of a swimmer, to add buoyance to the lower portion of the body of the swimmer in order to assist the swimmer to only employ and rely upon arm movement while swimming. Hence, the pull buoy symbol is intended to represent swimming with arms only, while the swimmer employs a pull buoy device to add buoyance to the lower portion of the body of the swimmer.

The graphic symbol 240*b* is employed to represent the free style swimming exercise. As shown, these types of exercises can be represented with graphic symbols, as opposed to being represented by string of text characters, such as for example, representing a an exercise via the word "free". In some circumstances, a graphic symbol marking can occupy less physical space on the information strip 116, than physical space occupied by an equivalent textual (word) marking.

In one embodiment, each information strip 116 is dimensioned to be about 7 millimeters (mm) in height (as measured between the upper 234*a* and lower edges 234*b* of the strip), to be about 2 mm in thickness (depth) and about 300 mm in length (as measured along the long dimension of the strip). The text characters and symbols are sized to about 5-6 mm in height, as printed or etched into the outer surface 232*a* of the strip 116. The size of such text characters and symbols are significantly smaller than what can be typically hand written, and enable dense packing of information onto the outside surface of the body 120 of a fluid container 110, while such markings are highly resistant to water and wetness related damage.

Figure 3:
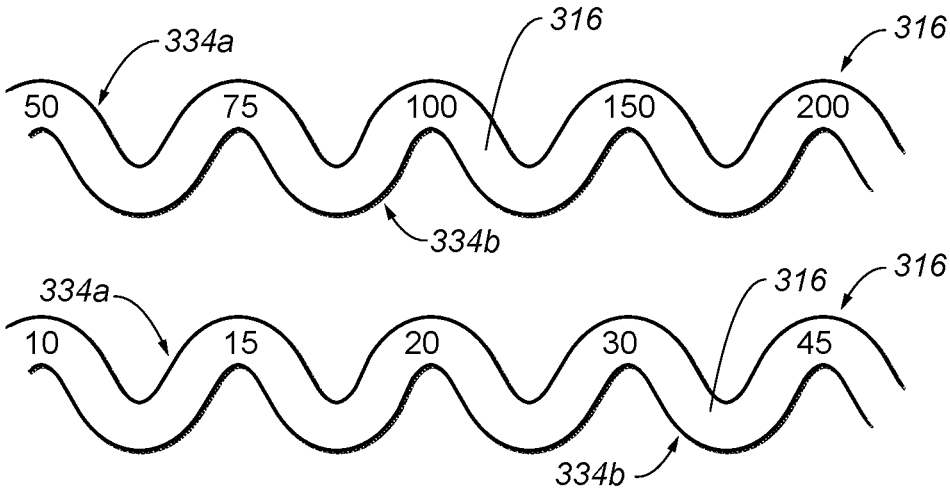
FIG. 3 illustrates another (wave) embodiment of an information strip that is designed to attach to an outer surface of the fluid container of FIGS. 1A-1C.

FIG. 3 illustrates a wave embodiment 316 of an information strip 116 that is also designed to attach to an outer surface of the fluid container of FIGS. 1A-2B. As shown, an upper edge 334*a* and a lower edge 334*b* of the strip 316, are not straight edges, as shown in FIG. 2A, but instead define a boundary shape like an oscillating wave form, and are said to have a wave like edge boundary shape or wave like edge perimeter. These are referred to herein as wave shaped strips 316 or wave shaped rings 316. Notice that each marking on each information strip 316 occurs in one and only one wave cycle, to ensure that any two markings between different information strips 316 can be aligned, when such strips 316 are abutted together. The wave like perimeter enables each strip 316 to interlock with adjacent strips 316 while the strips 316 are disposed upon and/or attached to the outer surface of the body 120.

In this embodiment, a base wave strip (ring) 316 is fixed to the outer surface of the body 120 of the container 110. Other wave shaped strips (rings) 316 are stacked upon and align with the wave pattern of the base wave strip (ring). A lock strip (ring) 316 is stacked above the other wave shaped strips (rings) and functions to prevent the stacked strips (rings) from sliding in an upwards direction. The base wave ring functions to prevent the other wave shaped rings from sliding in a downward direction.

In other embodiments of the information strip 116, the upper 234*a* and lower 234*b* edges of the strips 116 are designed to have small teeth that allow an upper and lower edge of each strip to interlock with other abutting strips to facilitate such strips 116 locking together when aligned and disposed and/or attached to the body 120 of the container 110. In some embodiments, the teeth are cut at a linear density of (10) teeth between markings on the information strip 116.

In some embodiments, each strip 116 is color coded to facilitate easier differentiation between strips 116 and easier reading of strips 116. The strips 116 can be removed for cleaning and re-arrangement onto the body 120 of the container 110.

FIGS. 4A-4E illustrate second embodiment of a fluid container and information strip combination. FIG. 4A illustrates a side perspective view 400 of a container 410 in accordance with the invention. Referring to FIG. 4A, the container 410, also referred to herein as a bottle 410, includes a body 420, a removable and re-attachable cap 412 and an outlet (opening) (not shown). The outlet can be sealed, and is shown here as being sealed, via the cap 412. The cap 412 is designed to attach to the body 420. In the embodiment shown, the cap 412 is designed to include an internal set of circular threads (not shown) which are designed to engage circular threads that are disposed along an outside surface of an upper portion of the body 420 and adjacent to an edge of the opening (not shown here). The body 420 functions as a container to store a material, including a fluid, such as water, for example. In some embodiments, the container 410 may include other openings to serve other functions, such as for cleaning etc. In some embodiments, the body 420 is further designed to preferably include a visible marking line as (like that) shown in FIG. 1A (not shown in FIG. 4A).

The body 420 is designed to accommodate attachment to a set of one or more information strips 416, also referred to herein as strips 416, rings 416 or sleeves 416. As shown here, the body 420 is standing upright and upon a horizontal surface. In this embodiment, the body 420 has a long dimension and a vertical dimension which are each parallel to each other and that are each oriented in a direction that is parallel to a Y axis 170.

The container 410 of FIG. 4A, unlike the container 110 of FIG. 1A, has a set of rails 450 that each attach along the outer surface of the body 420 of the container 410. In the embodiment shown here, there are a total of (6 rails) that are attached to the outer surface of the body 420. However, there are only (4) rails 450*a*-450*d* that are visible from this viewing perspective of FIG. 4A. Rails 450*e* and 450*f* are not visible within FIG. 4A, however a cross-section of these (2) rails is shown in FIG. 4B.

Each of the set of rails 450 protrudes away from an outer surface of the body 420. Preferably, each rail is a protrusion having a curved cross-sectional profile, for example having a partial cylindrical or full cylindrical cross-sectional profile, for example as shown in FIG. 4B. Optionally, a portion of a cross-sectional profile of each rail is embedded into the body 420. For example, a semi-circular half of a cylindrical profile of each rail can be embedded into the body 420 while a remaining semi-circular half of the cylindrical profile remains protruding away from the outer surface of the body 420.

As shown here, each rail 450 is a protrusion that protrudes away from the outer surface of the body 420. The protrusion of the rail has a half-cylindrical cross-sectional shape and is alternatively referred to herein as a rod. As shown here, each of the set of rails 450, as attached to the outer surface of the body 420 of the container 410, has a long dimension that is oriented in a direction that is parallel to the Y axis 170. In some embodiments, for example, the rails 450 protrude between 40-80/1000 of an inch from the outer surface of the body 420. However, the scope of the invention is not limited to such dimensions.

As shown here, the body 420 of the container 410 has long dimension that is oriented in a direction that is parallel to the Y axis 170. The body 420 also has an associated center axis 430 that is located at a geometric center of a horizontal cross-section of the body 420, having a circular shape, as shown in FIG. 4B. The outer surface of the body 420 curves around and surrounds the center axis 430. Accordingly and as shown here, the set of rails 450, including rails 450*a*-450*b*, each have a long dimension that is oriented in a direction that is parallel to the vertical dimension, the long dimension and to the center axis of the body 420 of the container 410, while each rail 450 is attached along the outer surface of the body 420 of the container 410.

Preferably, the rails 450 are each attached at an equal distance from each other and collectively span 360 degrees around the horizontal cross-section body 420. Accordingly, given that the horizontal cross-section of the body 420 of the container 410 is of a circular shape having a curved perimeter that spans an angular distance of 360 degrees, each rail of the set of (6) rails 450 is disposed at a uniform angular distance of 60 degrees=(360 degrees/6 rails) apart from each other.

FIG. 4B illustrates a top-down cross-sectional view of the body 420 of the container 410 shown in FIG. 4A in accordance with the invention. The body 420 of FIG. 4A has a horizontal cross-section 452, being a cross-section that is oriented parallel to a two dimensional plane defined by a combination of the X 180 and Z 190 axes. Preferably, the horizontal cross-section of the body 420 has a shape that is curved and symmetrical in shape. As shown, the horizontal cross-section 452 of the body 420 of FIG. 4A is circular in shape. Also shown are the horizontal cross-sections of the (6) rails 450*a*-450*f*, which are protrusions that are each about half circular in shape.

Figure 4D:
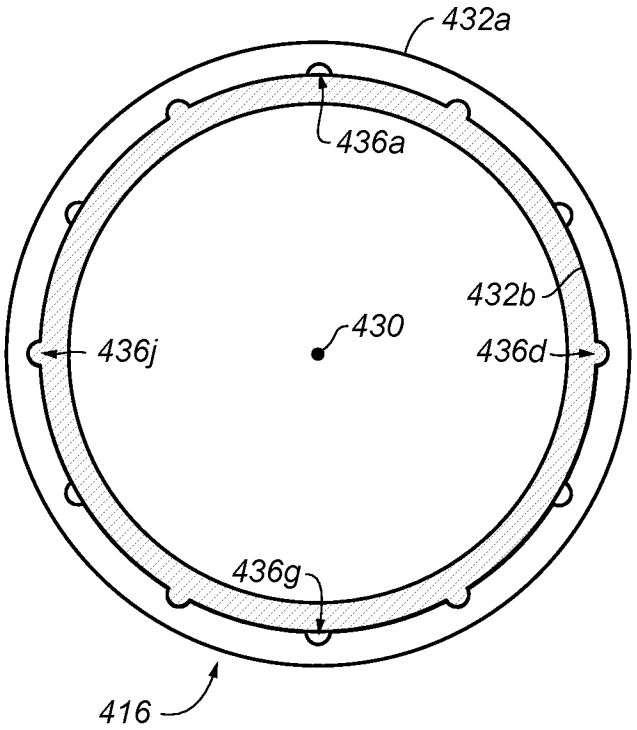
Figure 4C:
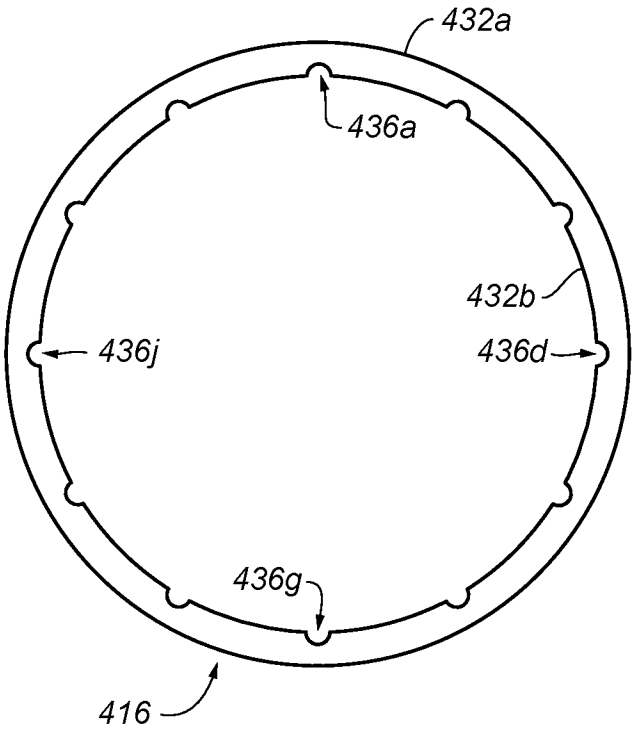

FIG. 4C illustrates a top-down view of an information strip 416 that is configured (designed) to attach to the outer surface of the body 420 of the container 410 shown in FIG. 4A, in accordance with the invention. The information strip 416, unlike the information strip 116 of FIG. 2A, has an inner surface 432*b* that includes a set of notches (cavities/indentations) 436. Each notch 436 is shaped and sized to receive and substantially surround a rail 450*a*-450*f* that is attached to the outer surface of the body 420 of the container 410.

As shown here, the set of notches 436, includes (12) notches 436*a*-4361. Each notch 436*a*-4361 of the set of notches 436 is disposed at a location that is an equal and uniform distance from each other adjacent notch 436. Accordingly, given that the horizontal cross-section of the body 420 of the container 410 is of a circular shape having a curved perimeter that spans an angular distance of 360 degrees, each of the set of (12) notches 436*a*-4361 is disposed at an angular distance of 30 degrees=(360 degrees/12 notches) apart from each other.

Like the information strips 116 of FIG. 2A, an outside surface 432*a* of the information strip 416 is configured (designed) to enable marking and to be marked like the information strip 116 as it is shown in FIGS. 1A-1B. As shown, the horizontal cross-section of each and every notch of the set of (12) notches 436*a*-4361 is of a semi-circular shape, being in this instance, a half-circular shape.

FIG. 4D illustrates a top-down cross-sectional view of the information strip 416 of FIG. 4C as it is attached to the body 420 of the container 410. As shown and designed, the information strip 416 can be rotated around a perimeter of the curved outer surface of the body 420 via hand manipulation. Each notch 436*a*-4361 is designed to receive and/or slide over each rail 450*a*-450*f* while attached to the body 420 via hand manipulation. When a notch 436*a*-4361 receives a rail 450*a*-450*f*, it is referred to herein as soft latching onto the rail 450, because without further application of a rotational force, the information strip 416 settles at (into) that rotational position. Further application of a rotational force via hand manipulation, for example, causes further rotation of the information strip 416.

While attached to the body 420 of the container 410, each information strip 416 is designed to slide along the body 420 of the container 410 in a direction that is parallel to the center axis 430 of the body 420 of the container 410. When attached to the body 420, each rail 450 is received by a separate one notch 436 of the information strip 416. Each and every notch 436 is sized to receive and slide along a rail 450 in a longitudinal direction that is parallel to the center axis of the body 420.

Figure 4F:
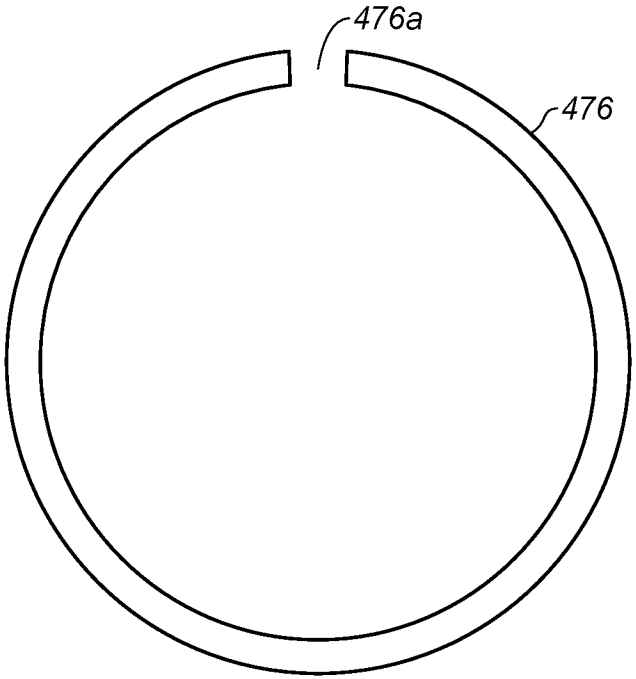
Figure 4E:
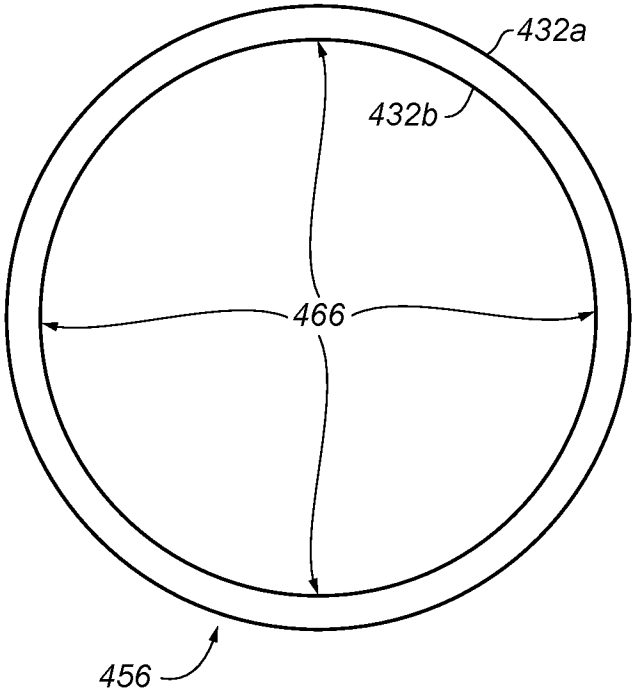

FIG. 4E illustrates a top-down view of a barrier strip 456 that is designed to surround and attach to the body 420 of the container 410. In this embodiment, like the information strip 416 of FIG. 4C, each barrier strip 456 has an outer surface 432*a* and an inner surface 432*b*.

Preferably, for each container 410, there is an upper barrier strip 456*a* and a lower barrier strip 456*b* that are each configured (designed) to surround and fixedly attach to the body 420 of the container 410, while surrounding (bounding) other information strips 416 that are attached to the body 420 of the container 410. Such bounding restricts the location of such information strips 416 to within in a vertical range along the outer surface of the body 420, where such vertical range is oriented parallel to the center axis 430 of the body 420 of the container 410.

The lower barrier strip 456*b* is designed to prevent a set of information strips 416 that are attached to the body 420 and disposed above the lower barrier strip 456, from sliding along the rails 450 and in a direction towards a lower portion of the container 410 and sliding off of the rails 450 and away from the body 420 of the container 410, with respect to the orientation of the container 410 as shown in FIG. 4A.

The upper barrier strip 456*a* is designed to prevent a set of information strips 416 that are disposed below the upper barrier strip 456, from sliding along the rails 450 and in a direction towards an upper portion of the container 410 and off of the rails 450 and away from the body 420 of the container 410, with respect to the orientation of the container 410 as shown in FIG. 4A.

In a preferred embodiment, at least one lower barrier strip 456*b* is fixedly and non-permanently attached to the body 420 of the container 410 at the location at or above the location 460*b* as shown in FIG. 4A. In some embodiments, the barrier strip 456*b* includes a threaded surface 466, being threads 466 that are located along an inner surface 432*b* that are designed to engage a threaded (area) surface 460*b* along the outer surface of the body 420 of the container 410 at location 460*b*. In this embodiment, the lower barrier strip 456*b* can be attached and detached via engagement and reverse engagement of the threads respectively, between the barrier strip 456*b* and the body 420.

In other embodiments, the lower barrier strip 456*b* is fixedly and permanently attached to the body 420 of the container 410 via an adhesive, such as a plastic to plastic glue. In this embodiment, the body 420 of the container 410 is not required to have a threaded surface 460*b* along the outer surface of the body 420 of the container 410 at location 460*b*. However, removal of the lower barrier strip 456*b* from the body 420 could cause damage to the outside surface of the body 420.

In other embodiments, the lower barrier strip 456*b* is designed to have a friction fit between the inner surface 432*b* of the barrier strip 456*b* and the body 420 of the container 410 at locations at or above the location 460*b*. In this embodiment, the inner diameter of the barrier strip 456 is sized so that there is a friction fit between the inner surface 432*b* of the barrier strip 456 and the outer surface of the body 420, at a particular location on the body 420.

For example, the barrier strip 456*b* is configured (designed) to surround and slide over the body 420 of the container 410 at location 460*b* (below and away from the rails 450) via forces provided by hand manipulation, while causing sufficient friction between the inner surface 432*b* of the barrier strip 456*b* and the outer surface of the body 420, to prevent information strips 416 that are attached to the rails 450 from sliding beyond the lower barrier strip 456*b* and sliding off of the body 420 of the container 410, in response to the forces of gravity and forces caused by movement of the container 410. Preferably, 8 or more pounds of force are required to slide this embodiment of the barrier strip 456*b* off of the body 420 of the container 410.

Or optionally, the barrier strip is configured (designed) to surround and slide over the body 420 of the container 410 to arrive at a location (along the rails 450) via forces provided by hand manipulation, while causing sufficient friction between the inner surface 432*b* of the barrier strip 456*b* and the rails 450, to prevent information strips 416 that are attached to the rails 450 from sliding beyond the lower barrier strip 456*b* and sliding off of the body 420 of the container 410, in response to the forces of gravity.

In a preferred embodiment, at least one upper barrier strip 456*a* is fixedly and non-permanently attached to the body 420 of the container 410 at the location at or below the location 460*a* as shown in FIG. 4A. In some embodiments, the barrier strip 456*b* includes a threaded surface 466, being threads 466 that are located along an inner surface 432*b* that are designed to engage a threaded (area) surface 460*a* along the outer surface of the body 420 of the container 410 at location 460*a*. In this embodiment, the upper barrier strip 456*a* can be attached and detached via engagement and reverse engagement of the threads respectively, between the barrier strip 456*a* and the body 420 of the container 410.

Referring to the upper barrier strip 456*a*, in some embodiments, the upper barrier strip 456*a* is designed to have a friction fit between the inner surface 432*b* of the barrier strip 456*a* and the body 420 of the container 410 at locations at or below the location 460*a*. In this embodiment, the inner diameter of the barrier strip 456*a* is sized so that there is a friction fit between the inner surface 432*b* of the barrier strip 456*a* and the outer surface of the body 420, at a particular location on the body 420 of the container 410.

For example, the upper barrier strip 456*a* is configured (designed) to surround and to slide over the body 420 of the container 410 at location 460*a* (above and away from the rails 450) provided by forces of hand manipulation, while causing sufficient friction between the inner surface 432*b* of the barrier strip 456*a* and the outer surface of the body 420, to prevent information strips 416 that are attached to the rails 450 from sliding beyond the upper barrier strip 456*a* and sliding off of the body 420 of the container 410, in response to the forces caused by gravity and forces caused by movement of the container 410. Preferably, 8 or more pounds of force are required to slide this embodiment of the barrier strip 456*a* off of the body 420 of the container 410.

Or optionally, the upper barrier strip 456*a* is configured (designed) to surround and slide along the body 420 of the container 410 at location (along the rails 450) via forces provided by hand manipulation, while causing sufficient friction between the inner surface 432*b* of the barrier strip 456*b* and the rails 450, to prevent information strips 416 that are attached to the rails 450 from sliding beyond the upper barrier strip 456*a* and sliding off of the body 420 of the container 410, in response to the forces of gravity and to forces caused by movement of the container 410. Preferably, 8 or more pounds of force are required to slide this embodiment of the barrier strip 456*a* off of the body 420 of the container 410.

FIG. 4F illustrates a lock ring 476 as shown in an un-expanded state. In other embodiments of the barrier strips 456*a*-456*b*, the upper barrier strip 456*a* and/or the lower barrier strip 456*b*, is implemented as a lock ring 476 as shown in FIG. 4F. The lock ring 476 is configured (designed) to expand (enlargement of inner diameter) and to un-expand via forces of hand manipulation. Expansion of the lock ring 476 is enabled by a gap 476*a* designed within the lock ring 476.

For this embodiment, grooves along the outer surface of the body 420 are implanted into the outer surface of the body 420 and are oriented parallel to a long dimension of information strips 416 that are attached to the body 420. The groove are configured (designed) and sized to receive the lock ring 476 when the lock ring 476 is in an un-expended state.

The lock ring 476 is expanded in order to slide the lock ring 476 along the outer surface of the body 420. The lock ring 476 is placed into a selected groove and un-expanded to lock into a position along the body 420 of the container. Such a groove can be located along the rails 450, or above or below the rails 450.

Other embodiments of the barrier strips 456*a*-456*b* can be implemented with a barrier strip 456 including a draw latch, also referred to herein as a lever lock, which enables expansion and un-expansion (contract) of the barrier strip 456*a*-456*b* to enable positioning (sliding) over and onto the body 420, and attachment to and detachment from the body 420 of the container 410, without the outer surface of the body 420 of the container 410 necessarily requiring a groove to receive this type of barrier strip 456*a*-456*b*.

This embodiment is designed like a belt and belt buckle combination, where the barrier strip wraps around the body 420 like a belt and the draw latch operates like a belt buckle to contract (un-expand) the barrier strip to surround and grip the body 420 of the container 410, at a desired location. The draw latch can alternatively expand the barrier strip to loosen the grip of the barrier strip to enable re-positioning and/or removal of the barrier strip from the outer surface of the body 420 of the container 410.

Other embodiments of the barrier strips 456*a*-456*b* can be implemented where lock screws are included within the barrier strips 456*a*-456*b*. The lock screw mechanism enables someone to expand and un-expand the barrier strips 456*a*-456*b* without the outer surface of the body 420 of the container 410 necessarily requiring a groove to receive this type of barrier strip 456*a*-456*b*.

As a result, in some embodiments, both the upper and lower barrier strips can be slid to a location along the rails 450 that is located at or located in between the threaded areas 460*a*-460*b*. In some embodiments, more than (2) barrier strips can be employed to partition and to form boundaries delimiting groupings (groups) of information strips 416.

The components for the invention are preferably made from a plastic or other polymer based material. However, the scope of the invention is not limited to being made from a particular material or set of materials. There is no requirement that the components of the invention be made from one same material.

As for dimensions, for example, the body 120, 420 of a hand held container 110, 410, is typically 3-4 inches in horizontal cross-sectional diameter, excluding protrusions such as the rails 450. However, the invention is not limited to such particular dimensions of the body of the container 110, 410, nor is any other component of the invention limited to a particular set of dimensions.

The scope of the invention is not intended to be limited to particular dimensions for a container 110, 410, nor limited to a particular dimensions of information strips 116, 416, nor limited to a particular number of rails 450, nor limited to particular dimensions of rails 450, nor limited to a particular number of notches 140, 436 nor limited to particular dimensions of notches 140, 436, for example. Hand manipulation is understood to typically involve application of a force of ten pounds or less.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

PARTS LIST

100 side perspective view of container (FIGS. 1A-1B)
110 container (embodiment shown in FIG. 1A)
112 cap of container 110
112*a* outlet (opening) of cap of container
114 marking line
116 information strip (FIGS. 2A-2B)
118 grouping (set) of information
120 body of container 110
140 notches (along outer curved surface of body of container)
230 protrusion (at ends of information strip)
232*a* inner (curved) surface of information strip
232*b* outer (curved) surface of information strip
234*a* upper edge of information strip
234*b* lower edge of information strip
240 markings of graphic symbols
316 wave shaped information strip
334*a* upper edge of wave shaped information strip
334*b* lower edge of wave shaped information strip
400 side perspective view of container (FIG. 4A)
410 container (embodiment shown in FIG. 4A)
412 cap of container 410
416 information strip (FIGS. 4C-4D)
420 body of container 410
432*a* outside surface of the information strip 416
432*b* inside surface of the information strip 416
436 notches (along inner curved surface of information strip 416)
450 rails
452 horizontal cross-sectional view of container 410
456 barrier strip(s)
456*a* upper barrier strip
456*b* lower barrier strip
460*a* upper threaded (area) surface of container 420
460*b* lower threaded (area) surface of container 420
466 threaded surface, threads of barrier strip
476 lock ring
476*a* gap of lock ring

What is claimed is:

1. A fluid container, comprising:

a body that functions as a container, said body surrounding a cavity that is configured for storing a fluid, and wherein said body has a vertical dimension and a center axis that is directed parallel to said vertical dimension, and wherein said body has an outer surface that surrounds said center axis; and wherein said body having at least one opening that is designed to facilitate transfer of fluid to and from said cavity; said opening being designed to be opened or closed with respect to said transfer of fluid to and from said cavity; and wherein said outer surface of said body is further configured for providing a mechanism for encoding a set of information; said mechanism including a set of rails and a set of information strips, said rails each having a long dimension that is oriented parallel to said center axis while said rails are attached to said outer surface of said body;

said information strips are each configured for attachment to said outer surface of said body via said rails and each information strip including at least one marking that encodes information that is viewable to a holder of said container while said information strips are attached to said outer surface of said body, and wherein said information strips are each configured to be attachable to and detachable from, and re-attachable to, said outer surface of said body via forces of hand manipulation.

2. The fluid container of claim 1, wherein each of said information strips are further configured to rotate and rotationally latch into one of a plurality of rotational positions via hand manipulation and while attached to said outer surface of said body via said rails.

3. The fluid container of claim 1, further comprising a marking line that points to a location upon each one of a set of one or more information strips while said strips are attached to said outer surface of said body.

4. The fluid container of claim 1 wherein each said at least one marking encodes information representing an activity.

5. The fluid container of claim 4 wherein said activity is a type of exercise.

6. The fluid container of claim 4, wherein at least one information strip includes at least one marking that is a symbol, said symbol representing an activity.

7. The fluid container of claim 3, wherein at least one of said markings represents a numerical value.

8. The fluid container of claim 1 wherein each of said information strips is assigned one of a set of distinct colors.

9. The fluid container of claim 1 wherein movement of said information strips is contained within an upper barrier strip and a lower barrier strip, while said upper barrier strip and a lower barrier strip are attached to said outer surface of said body.

* * * * *